US009925443B2

(12) United States Patent
Roberson

(10) Patent No.: US 9,925,443 B2
(45) Date of Patent: Mar. 27, 2018

(54) THROW WEIGHT

(71) Applicant: Seth Ashley Roberson, Polk City, IA (US)

(72) Inventor: Seth Ashley Roberson, Polk City, IA (US)

(73) Assignee: Hadar MFG, Inc., Humboldt, IA (US)

( * ) Notice: Subject to any disclaimer, the term of this patent is extended or adjusted under 35 U.S.C. 154(b) by 112 days.

(21) Appl. No.: 14/311,926

(22) Filed: Jun. 23, 2014

(65) Prior Publication Data

US 2015/0367214 A1 Dec. 24, 2015

(51) Int. Cl.

*A63B 65/00* (2006.01)
*A63B 65/06* (2006.01)
*A63B 65/04* (2006.01)

(52) U.S. Cl.

CPC ..... *A63B 65/06* (2013.01); *A63B 65/04* (2013.01); *A63B 2244/17* (2013.01)

(58) Field of Classification Search

CPC ..... A63B 21/0601; A63B 21/0603; A63B 21/072; A63B 21/1469; A63B 21/1496; A63B 65/00; A63B 65/04; A63B 65/06; A63B 47/007; A63B 65/12; A63B 65/122; A63B 65/125; A63B 59/20; A45C 13/30; A45C 13/26; A45C 2013/265; A45C 2013/267; A45C 2013/303

USPC ... 482/20, 44, 49, 50, 91–93, 106–111, 139, 482/910; 383/71, 76, 121, 907; 294/137, 294/149, 150, 153, 157, 167, 169; 206/315.9, 315.91; 224/250, 579; 124/5; 473/423–430, 575, 578, 612

See application file for complete search history.

(56) References Cited

U.S. PATENT DOCUMENTS

| | | | | | |
|---|---|---|---|---|---|
| 910,875 | A | * | 1/1909 | Slade | 383/121 |
| 1,122,157 | A | | 12/1914 | Reach | |
| 2,201,802 | A | * | 5/1940 | Steiner | A63B 65/125 473/511 |
| 3,322,176 | A | * | 5/1967 | Geller | 383/6 |
| 4,054,166 | A | * | 10/1977 | Burke | 206/423 |
| 4,131,102 | A | * | 12/1978 | Polly, Jr. | A63B 59/20 124/41.1 |
| 4,552,149 | A | * | 11/1985 | Tatsuki | 607/110 |
| 4,659,079 | A | | 4/1987 | Blanchard | |
| 5,085,320 | A | | 2/1992 | Scott | |
| 5,092,682 | A | * | 3/1992 | Fenick | 383/22 |
| 5,238,162 | A | | 8/1993 | LaCivita | |
| 5,238,305 | A | * | 8/1993 | Feller | 383/22 |
| 5,242,348 | A | * | 9/1993 | Bates | 482/105 |
| 5,427,084 | A | * | 6/1995 | Arnold | F41B 3/00 124/4 |
| 5,522,757 | A | * | 6/1996 | Ostrowski | 446/220 |
| D373,472 | S | * | 9/1996 | Eaton et al. | D3/257 |
| 5,713,805 | A | * | 2/1998 | Scher | A63B 69/0084 473/426 |

(Continued)

*Primary Examiner* — Gregory Winter

(74) *Attorney, Agent, or Firm* — Camille L. Urban; BrownWinick Law Firm

(57) ABSTRACT

A throw weight includes a handle and a bag rotatably associated with the handle. The bag is designed to hold a weight which can be interchanged with other weights. The bag and handle are particularly constructed and oriented relative to one another for the purpose of correctly stabilizing the weight and to facilitate ease of throwing. The bag may include an opening at an end of the bag opposite the handle.

7 Claims, 14 Drawing Sheets

(56) References Cited

U.S. PATENT DOCUMENTS

| | | | | |
|---|---|---|---|---|
| 6,062,520 | A * | 5/2000 | Ralston | A47G 7/047 248/318 |
| 6,062,622 | A * | 5/2000 | Susman et al. | 294/149 |
| 6,286,674 | B1 * | 9/2001 | Richard et al. | 206/315.9 |
| 6,387,022 | B1 | 5/2002 | Smith | |
| 6,447,037 | B1 * | 9/2002 | Crouch | B65D 33/14 294/149 |
| 6,481,591 | B2 * | 11/2002 | Mendoza et al. | 220/9.2 |
| 6,892,916 | B1 * | 5/2005 | Rugg | 224/645 |
| 7,275,669 | B1 * | 10/2007 | Aikens | B62J 9/003 206/315.9 |
| 7,811,212 | B2 | 10/2010 | Chen | |
| 7,883,452 | B1 | 2/2011 | Chen | |
| 7,976,443 | B2 | 7/2011 | Krull | |
| 8,104,459 | B2 * | 1/2012 | Young | F41B 3/04 124/1 |
| 2005/0072796 | A1 * | 4/2005 | Penfold | 222/105 |
| 2006/0035751 | A1 * | 2/2006 | Blair et al. | 482/49 |
| 2007/0049469 | A1 * | 3/2007 | Brown | 482/93 |
| 2010/0326854 | A1 | 12/2010 | Ting | |
| 2011/0287904 | A1 * | 11/2011 | Morris | 482/93 |
| 2011/0287909 | A1 * | 11/2011 | Morris | 482/126 |
| 2012/0149536 | A1 | 6/2012 | Trimble | |
| 2012/0322627 | A1 * | 12/2012 | Emerson | 482/93 |
| 2013/0337980 | A1 * | 12/2013 | Himmelrick et al. | 482/108 |

* cited by examiner

THROW WEIGHT

BACKGROUND

1. Field

Example embodiments are directed to a throw weight.

2. Description of the Related Art

Indoor track and field events are a popular throughout the United States. One popular indoor track and field event is the indoor weight throw. In this event, athletes compete by throwing a weight as far as possible. Some conventional throw weights include a handle connected to a bag which encloses a weight. In competition, an athlete grabs the handle, and rotates his/her body several times to increase a velocity of the throw weight. Once the athlete achieves a sufficient angular velocity, the athlete lets go of the throw weight.

SUMMARY

Example embodiments are directed to a throw weight.

In accordance with example embodiments, a throw weight may include a handle and a bag connected to the handle. In example embodiments the bag includes a hole at an end of the bag opposite the handle.

In accordance with example embodiments, a throw weight may include a handle, a connector connected to the handle, and a bag, wherein the bag is comprised of six trapezoidal shaped members connected to six looped members by at least one of one of stitching, gluing, stapling, and riveting and the six looped members are attached to the connector by a pair of looped members.

BRIEF DESCRIPTION OF THE DRAWINGS

Example embodiments are described in detail below with reference to the attached figures, wherein.

DETAILED DESCRIPTION

Figure 1A:
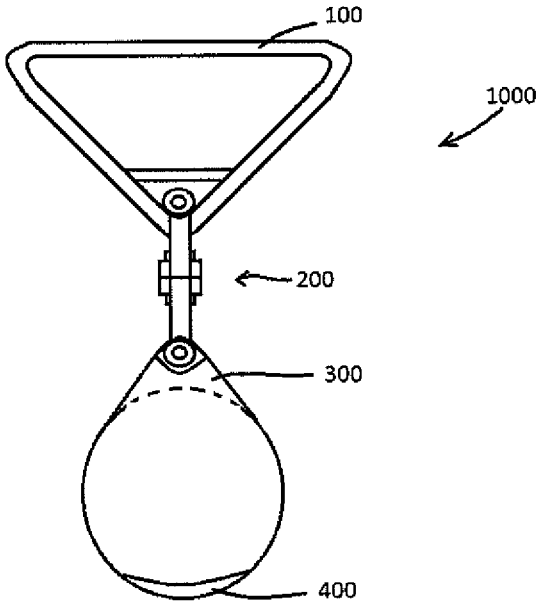
FIGS. 1A and 1B are views of a throw weight in accordance with example embodiments.

Example embodiments of the invention will now be described with reference to the accompanying drawings. Example embodiments, however, should not be construed as limiting the invention since the invention may be embodied in different forms. Example embodiments illustrated in the figures are provided so that this disclosure will be thorough and complete. In the drawings, the sizes of components may be exaggerated for clarity.

In this application, when an element is referred to as being "on," "attached to," "connected to," or "coupled to" another element, it can be directly on, attached to, connected to, or coupled to the other element or intervening elements that may be present. On the other hand, when an element is referred to as being "directly on," "directly attached to," "directly connected to," or "directly coupled to" another element, there are no intervening elements present. As used herein, the term "and/or" includes any and all combinations of one or more of the associated listed items.

In this application, the terms first, second, etc. are used to describe various elements, components, regions, layers, and/or sections. However, these elements, components, regions, layers, and/or sections should not be limited by these terms since these terms are only used to distinguish one element, component, region, layer, and/or section from other elements, components, regions, layers, and/or sections that may be present. For example, a first element, component region, layer or section discussed below could be termed a second element, component, region, layer, or section.

In this application, spatial terms, such as "beneath," "below," "lower," "over," "above," and "upper" (and the like) are used for ease of description to describe one element or feature's relationship to another element(s) or feature(s). The invention, however, is not intended to be limited by these spatial terms. For example, if an example of the invention illustrated in the figures is turned over, elements described as "over" or "above" other elements or features would then be oriented "under" or "below" the other elements or features. Thus, the spatial term "over" may encompass both an orientation of above and below. The device may be otherwise oriented (for example, rotated 45 degrees, 90 degrees, 180 degrees, or at other orientations) and the spatially relative descriptors used herein interpreted accordingly.

In this application, example embodiments may be described by referring to plan views and/or cross-sectional views which may be ideal schematic views. However, it is understood the views may be modified depending on manufacturing technologies and/or tolerances. Accordingly, the invention is not limited by the examples illustrated in the views, but may include modifications in configurations formed on the basis of manufacturing process. Therefore, regions illustrated in the figures are schematic and exemplary and do not limit the invention.

The subject matter of example embodiments, as disclosed herein, is described with specificity to meet statutory requirements. However, the description itself is not intended to limit the scope of this patent. Rather, the inventors have contemplated that the claimed subject matter might also be embodied in other ways, to include different features or combinations of features similar to the ones described in this document, in conjunction with other technologies. Generally, example embodiments are directed to a throw weight.

Figure 1B:
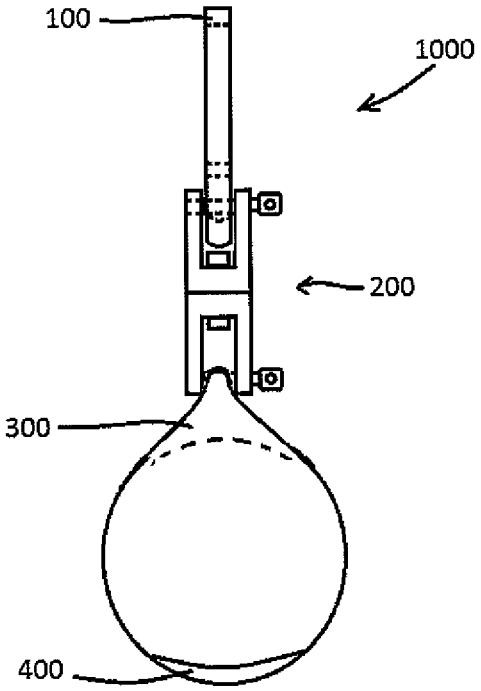

FIGS. 1A and 1B are views of a throw weight 1000 in accordance with example embodiments. As shown in FIGS. 1A and 1B, the throw weight 1000 may be comprised of a handle 100, a connector 200, a bag 300, and a weight 400. In example embodiments, the weight 400 may be arranged in the bag 300 and the bag 300 may be connected to the handle 100 by the connector 200. In example embodiments, the bag 300 may be a bottomless bag meaning that a portion of the bag facing away from the handle may have a hole 310 (see FIGS. 5A and 5B). Thus, the bag 300 may be configured so that the weight 400 may be partially exposed at a side of the bag 300 facing away from the handle 100.

Figure 2:
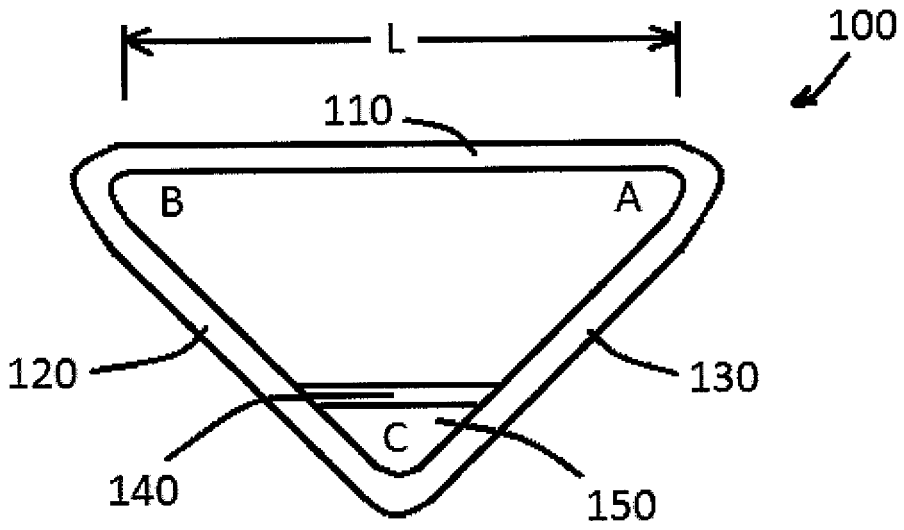
FIG. 2 is a view of handle in accordance with example embodiments.

FIG. 2 is a view of the handle 100 in accordance with example embodiments. In example embodiments, the handle 100 may have a triangular shape as shown in at least FIG. 2. For example, the handle 100 may have a first member 110, a second member 120, and a third member 130 arranged so as to form a triangle having a first angle A, a second angle B, and a third angle C. In example embodiments, cross sections of each of the first, second, and third members 110, 120, and 130 may be substantially circular.

In example embodiments the handle 100 may be configured so as to be easily grasped by the human hand. For example, a length L of the first member 110 may be about six to about nine inches and the cross section of the first member 110 may have a diameter of about one quarter of an inch. For example, a top flat part of the handle 100 may be about 7.5 inches, as measure on an inside portion of the first member 110 facing the third angle C. In example embodiments, the first second and third angles A, B, and C may about the same. For example each of angles A, B, and C may be about sixty degrees.

In example embodiments, a support member 140 may be included in the design of the handle 100. For example, the support member 140 may be arranged near the third angle C. In example embodiments, the support member 140 may resemble a short rod having a circular cross-section with a diameter of about one quarter of an inch. In example embodiments, an area 150 enclosed by the handle 100 near angle C may be a first connecting area to which the connector 200 may attach.

It is understood that the handle 100 described above and illustrated in the figures is not intended to limit the invention. For example, the handle 100 is not required to have a triangular shape but may, in the alternative, have a rectangular shape. As another example, rather than having a second and a third member 120 and 130 to form a triangular shaped handle, a single curved member resembling an arc may be used in lieu of the second and third members 120 and 130. In this latter embodiment, the handle may have an outline resembling a half circle. As yet another example, the handle may be ring shaped rather than triangular shaped. As yet another example, the handle 100 may resemble a post similar to a handle of a tennis racquet. Also, the dimensions provided above (and hereinafter) are merely for purposes of illustration and are not intended to limit the invention. For example, the handle 100 of example embodiments is not required to have a first member 110 having a length between six inches and nine inches as the length of the first member 110 may be less than six inches or more than nine inches. As another example, cross sections of the first, second, and third members 110, 120, and 130 are not required to be circular and are not required to be one quarter of an inch in diameter. As yet another example, the angles A, B, and C are not required to be the same. For example, angle C may be about 90 degrees and angles A and B may be about forty five degrees. In short, the handle 100 of example embodiments, as described above and illustrated in the figures, is exemplary only and is not intended to limit the invention.

Figure 3A:
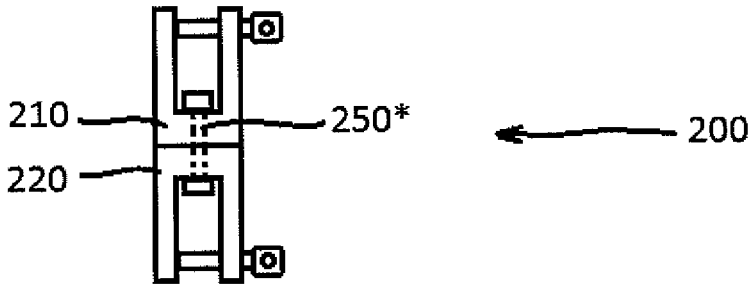
FIGS. 3A-3C are views of a coupler in accordance with example embodiments.
Figure 3B:
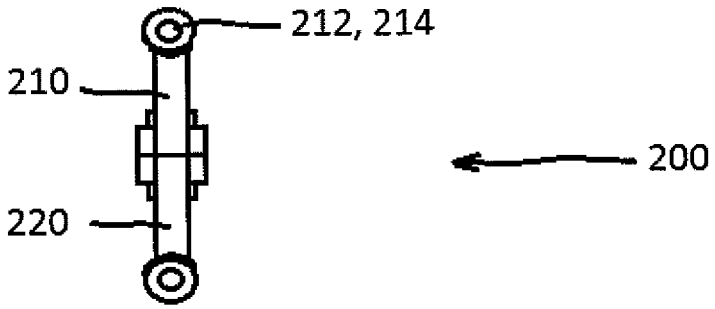
Figure 3C:
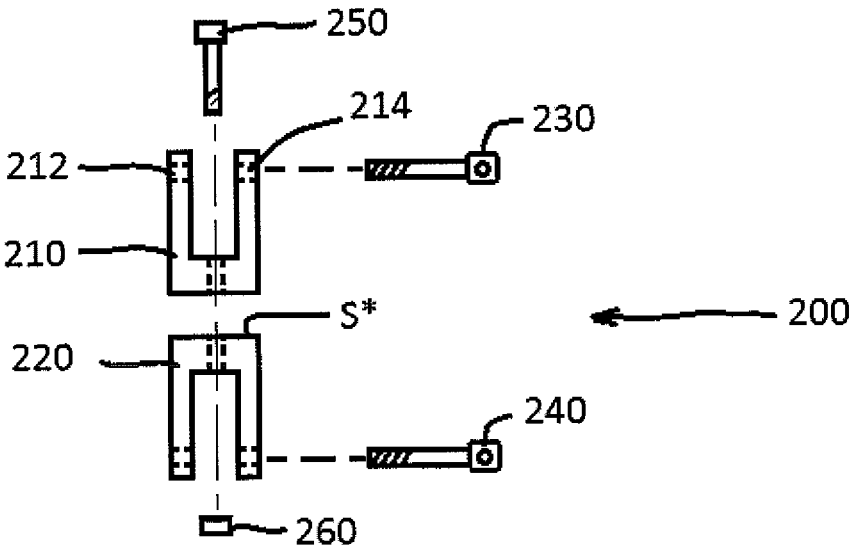

FIGS. 3A, 3B, and 3C illustrate an example of the connector 200 wherein FIG. 3A is a first side view of the connector 200, FIG. 3B is a second side view of the connector 200, and FIG. 3C is an exploded view of the connector 200. As shown in FIGS. 3A, 3B, and 3C, the connector 200 may include a first interfacing member 210, a second interfacing member 220, and a coupling member 250* attaching the first interfacing member 210 to the second interfacing member 220. In example embodiments, the coupling member 250* may be configured to allow the first interfacing member 210 to rotate relative to the second interfacing member 220. For example, the coupling member 250*may be comprised of a bolt 250 and a nut 260 as shown in the figures. In example embodiments, the bolt 250 may serve as an axis about which each of the first and second interfacing members 210 and 220 may rotate. Example embodiments are not limited to a coupling member 250* comprised of a bolt 250 and a nut 260. For example, coupling member 250* may be another structure, for example, a rivet.

Figure 4A:
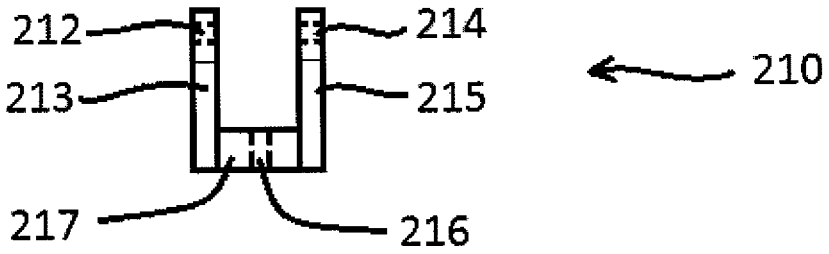
FIGS. 4A-4C are views of an interfacing member in accordance with example embodiments.
Figure 4B:
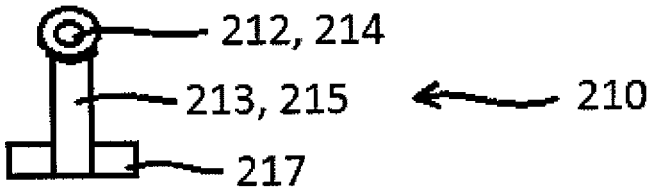
Figure 4C:
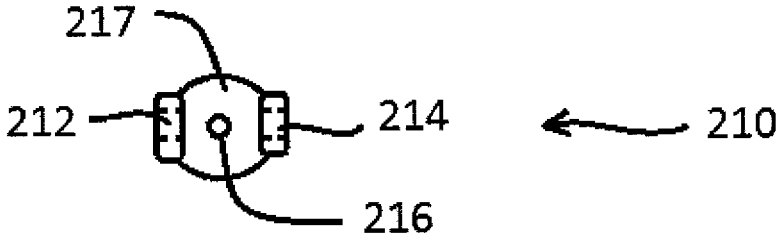

FIGS. 4A, 4B, and 4C are views of the first interfacing member 210 in accordance with example embodiments. As shown in FIGS. 4A, 4B, and 4C, the first interfacing member may include a first extension member 213 having a first hole 212 and a second extension member 215 having a second hole 214. In example embodiments, the first extension member 213 and the second extension member 215 may be connected to each other via a base member 217 which may resemble a substantially flat plate. In example embodiments, the base member 217 may include a third hole 216 through which the bolt 250 may pass. In example embodiments, the diameter of the third hole 216 may be small enough to prevent a head of the bolt 250 from passing therethrough but large enough for the body to pass through. As shown in FIG. 3C, a securing member 230 may pass through each of the first hole 212 and the second hole 214. For example, the securing member 230 may resemble a screw having a threaded end configured to engage threads that may be present in the first hole 212. Thus, in example embodiments, the securing member 230 may be inserted into the second hole 214 and then screwed into the first hole 212 to secure the securing member 230 in place.

In example embodiments, the second interfacing member 220 may be substantially identical to the first interfacing member 210, thus, a detailed description thereof is omitted for the sake of brevity. In example embodiments, the bolt 250 of the coupling member may pass through the third hole 216 of the first interfacing member and through a corresponding hole of the second interfacing member 220. In example embodiments, a length of the first bolt 250 may be greater than the thicknesses of the base members 217 of the first and second interfacing members 210 and 220, thus, a threaded end of the bolt 250 may be exposed in an area of the second interfacing member 220. Thus exposed, a nut 260 may be used to secure the bolt 250 in place as shown in at least FIG. 3C.

As explained previously, the specifics of the coupler 200 are not intended to limit the invention. For example, the second interfacing member 220 is not required to be identical to the first interfacing member 210. As another example, rather than using a bolt 250 and a nut 260 to form a coupling member 250*, the coupling member 250 may resemble a threaded post extending from a surface S* of the second interfacing member 220 into the third hole 216 of the first interfacing member 210 and a nut may be used with the threaded post to secure the first interfacing member 210 to the second interfacing member 220. As yet another example, rather than providing a threaded post, the post may not be threaded. This post may be inserted into the third hole 216 of the first interfacing member 210 and secured in place by a pin. In the alternative, an end of the post may be peened to prevent it from backing through the third hole 216. In addition, the connector 200 may be made from a conventional hardware, for example, a jaw-in-jaw type connector which is commonly found in the boating industry.

Figure 5A:
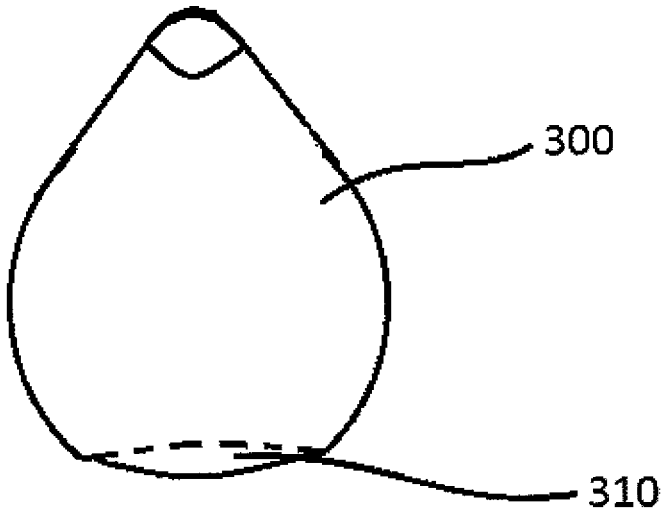
FIGS. 5A-5B are views of a bag in accordance with example embodiments.
Figure 5B:
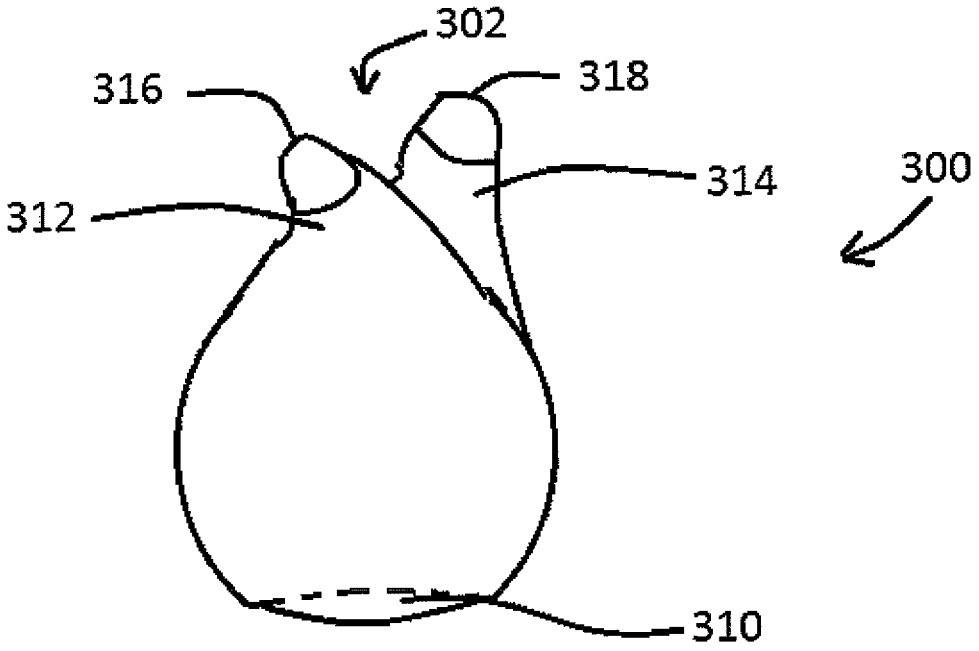

FIGS. 5A and 5B are views of the bag 300 in accordance with example embodiments. In example embodiments, a portion 302 of the bag 300 may be open to allow the weight 400 to be place therein. In this particular nonlimiting example, the portion 302 is arranged at one end of the bag 300. In example embodiments, a pair flaps 312 and 314 may allow an opening large enough for the weight 400 to be place therein. The pair of flaps 312 and 314, is not intended to limit the invention as the bag 300 may have more than two flaps or less than two flaps. In example embodiments, the flaps 312 and 314 may be brought together and ends 316 and 318 of the flaps 312 and 314 may be inserted into a region of the connector 200 for attachment thereto. For example, the ends 316 and 318 may include holes which may be inserted between the extensions of the second interfacing member 220 and the securing member 240 may be inserted into the holes of the flaps (as well as the first and second holes of the second interfacing member 220) to attach the bag 300 to the coupler 200.

In example embodiments, an end of the bag 300 may be open. That is, an end of the bag 300 may include the hole 310. The hole 310, however, should be small enough to prevent the weight 400 from passing completely therethrough. In example embodiments, for example, the hole 310 may resemble a circular hole having a diameter of about two inches to about six inches and thus may resemble a circle having an area of about three square inches to about thirty square inches. Example embodiments, however, are not limited thereto. For example, the hole may be polygon shaped. That is, the hole 310 may have another shape such as, but not limited to, a triangular, square, rectangular, pentagonal, hexagonal, octagonal shape having an area of about three square inches to about thirty square inches. In the alternative, the hole 310 may have an irregular shape covering an area of about three square inches to about thirty square inches. In example embodiments, the weight 400 may be a conventional weight used in conventional throw weights.

In example embodiments the hole 310 may be arranged at an end of the bag 300 facing away from the handle 100. In example embodiments, the hole 310 may be covered by a flexible material, for example, rubber to prevent the weight 400 from being exposed, yet allow the weight 400 to partially penetrate the hole 310.

In example embodiments the bag 300 may be comprised of a relatively flexible material, for example, canvas, leather, cloth, or nylon. For example, the bag 300 may be made from a seatbelt type material.

In example embodiments, the weight 400 may be a spherical weight. In example embodiments, the spherical weight may have a diameter of about four inches to about nine inches. For example, the weight 400 may resemble a weight used in a conventional throw weight. Example embodiments, however, are not limited thereto as the weight may have a diameter of less than four inches or greater than nine inches.

In example embodiments, the throw weight 1000 may be thrown in a manner similar to that of a hammer throw in conventional track and field competitions. For example, an athlete may grip the handle 100 of the throw weight 1000 and rotate his/her body until a sufficient rotational speed is attained. Once the sufficient rotational speed is attained, the athlete releases the throw weight 1000. A particular advantage of the throw weight 1000 of example embodiments is enabled by the hole 310 of the bag 300. Because the hole 310 is arranged at a location of the bag 300 facing away from the handle 100 the weight 400 can move slightly further away from the athlete as the athlete rotates since the weight 400 partially penetrates the hole 310. This increased distance allows the throw weight 1000 to attain a greater velocity than that obtained using conventional throw weights having bags with closed ends. Thus, the throw weight 1000 of example embodiments offers a significant advantage over the conventional art.

Figure 6:
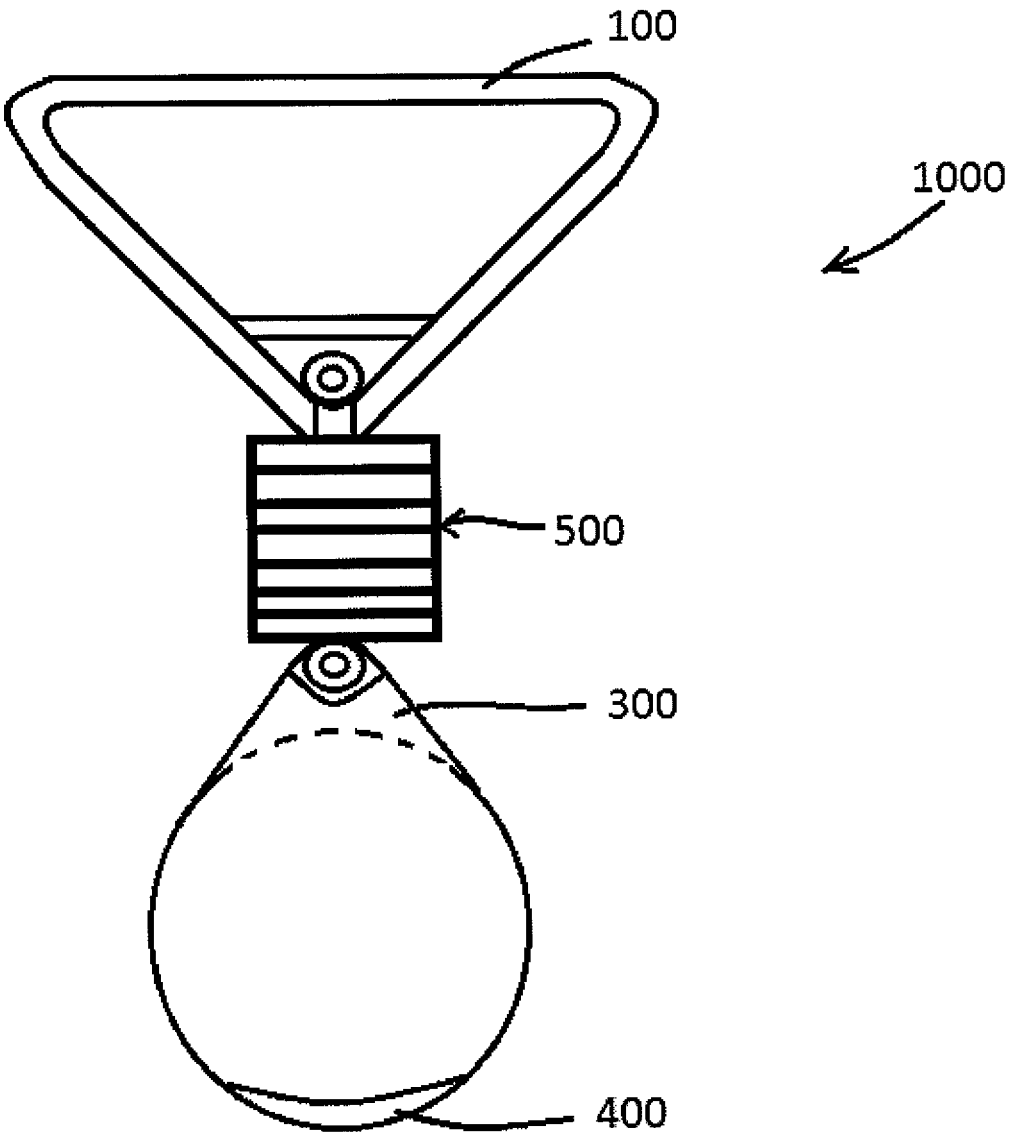
FIG. 6 is a view of the throw weight in accordance with example embodiments, wherein the throw weight further includes a sleeve.

In example embodiments, additional elements may be added to the throw weight 1000. For example, as shown in FIG. 6, the throw weight 1000 of example embodiments may further include a cylindrical sleeve 500. The cylindrical sleeve 500 may resemble a short corrugated sleeve made of a relatively light and flexible material, for example, plastic, and may have sufficient length to cover the connector 200. For example, in example embodiments, the cylindrical sleeve 500 may have a length of about two and a half inches and a diameter of about two inches.

Figure 7:
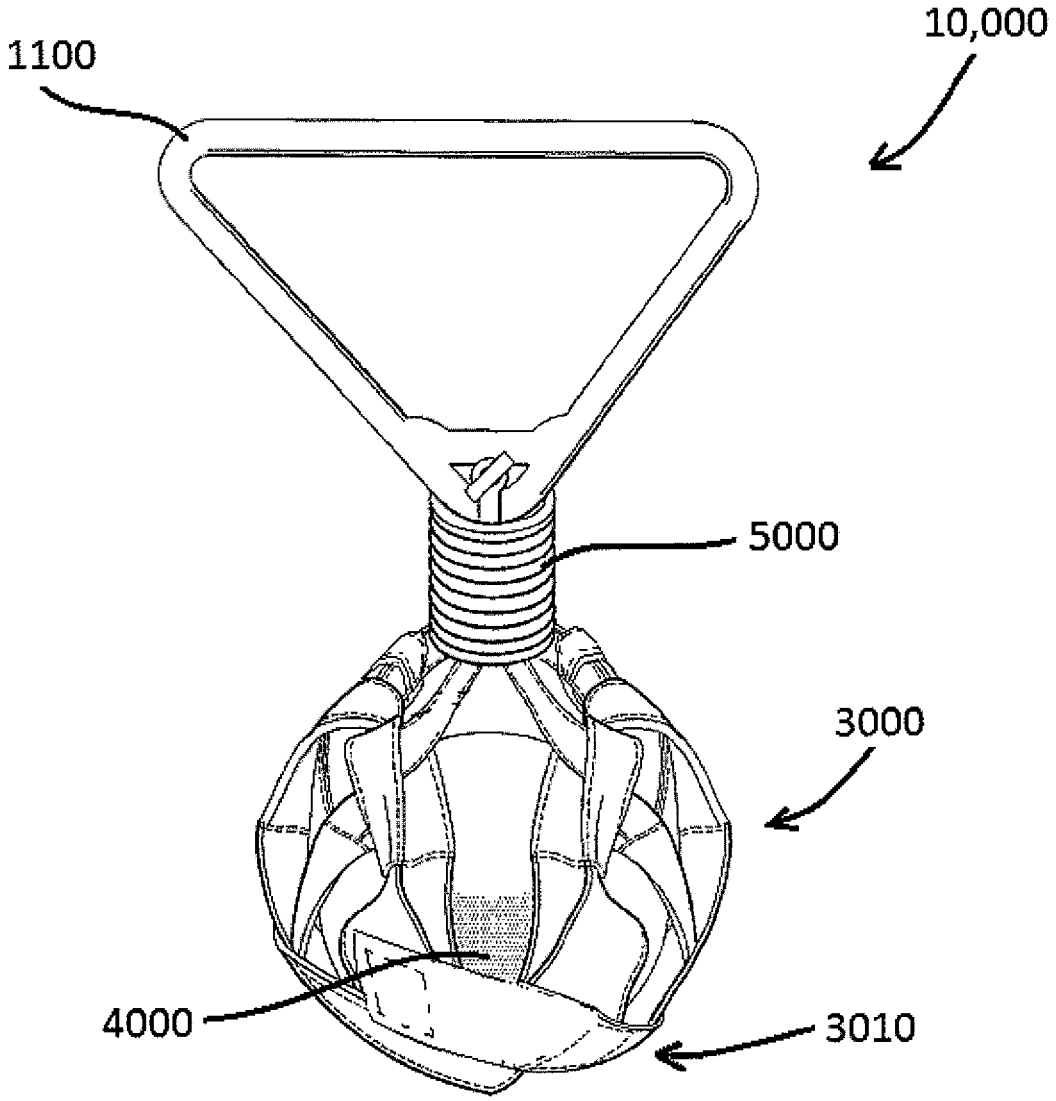
FIG. 7 is a view of a throw weight in accordance with example embodiments.
Figure 8:
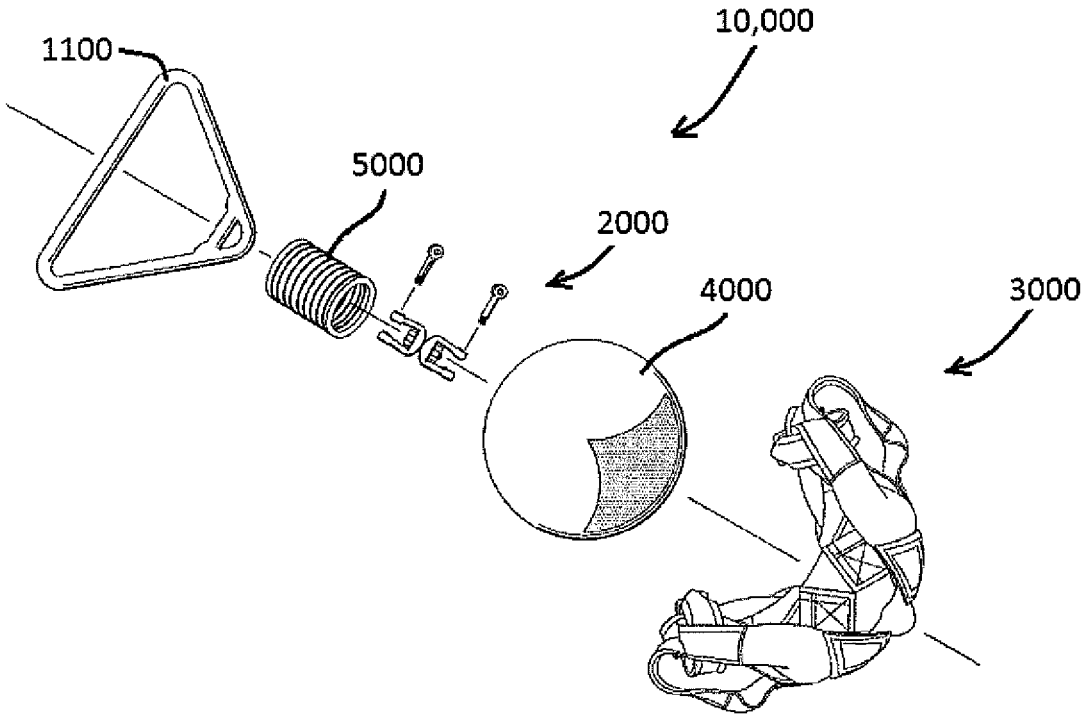
FIG. 8 is an exploded view of the throw weight in accordance with example embodiments.

FIG. 7 is a view of another throw weight 10,000 in accordance with example embodiments. FIG. 8 is an exploded view of the throw weight 10,000 in accordance with example embodiments. As shown in FIGS. 7 and 8, the throw weight 10,000 in accordance with example embodiments may include a handle 1100, a connector 2000, a bag 3000, a weight 4000, and a sleeve 5000. Because the handle 1100, the connector, the weight 4000 and the sleeve 5000 may be similar to the previously described handle 100, connector 200, weight 400, and sleeve 500, a detailed description thereof is omitted for the sake of brevity.

Figure 9:
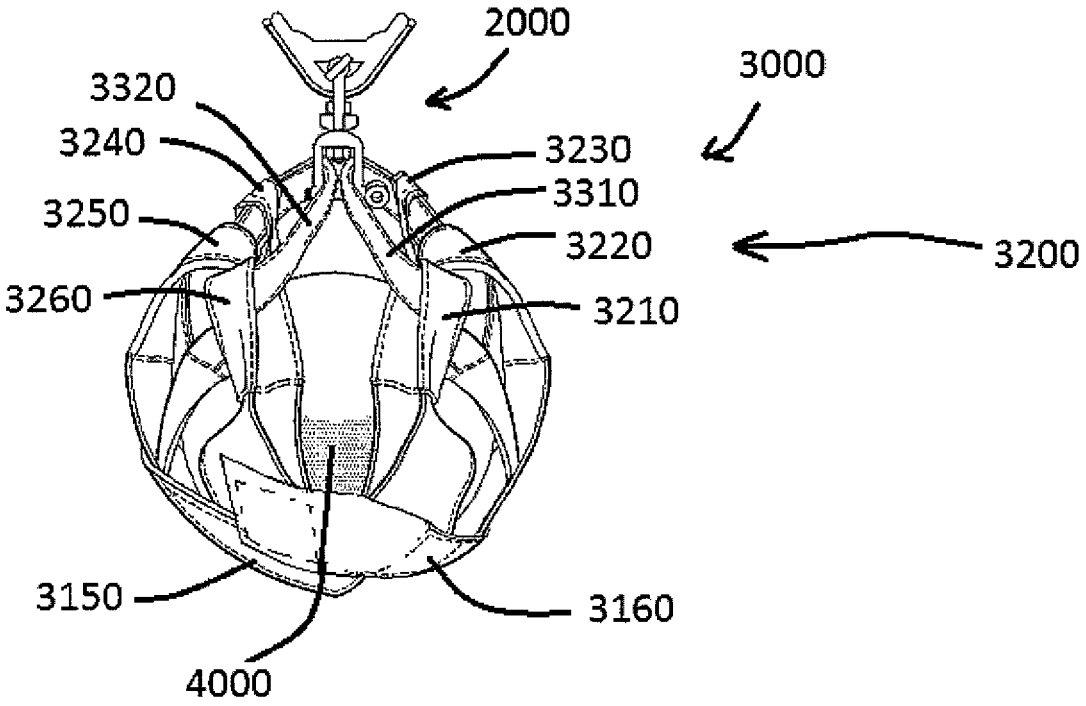
FIG. 9 is a close up view of the throw weight in accordance with example embodiments.
Figure 10:
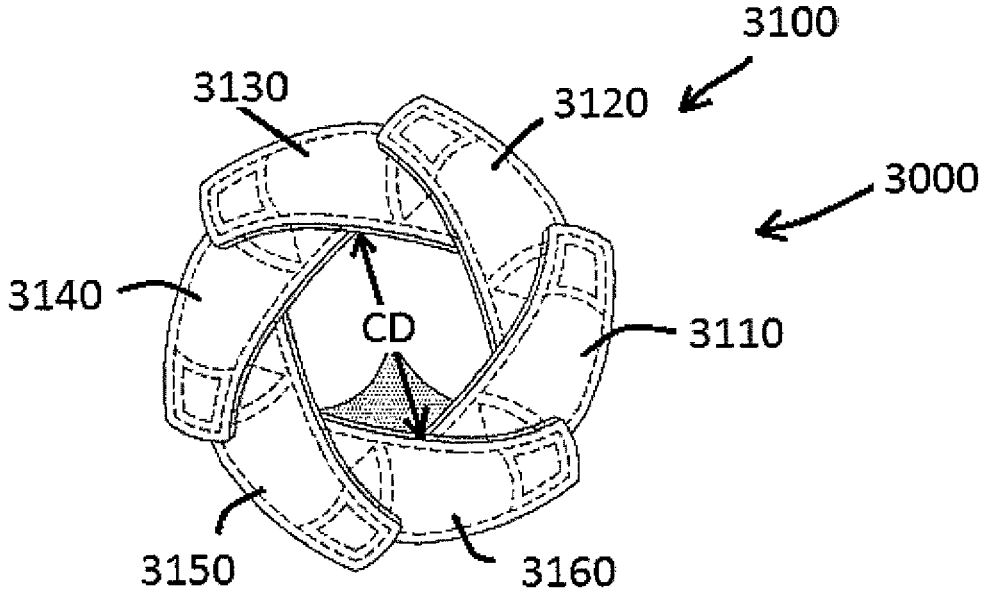
FIG. 10 is a bottom view of the throw weight in accordance with example embodiments.

FIG. 9 shows a close up view of the bag 3000 connected to the connector 2000 and FIG. 10 illustrates a bottom view of the bag 3000. As shown in FIG. 10, the bag 3000 may include a distal portion 3010 comprised of several members stitched together. Each piece, for example, may be made of a relatively stiff material for example, nylon, Kevlar, or a polyester. For example, several, or each, of the pieces may resemble the type of material found in a seat belt of a car. For example, as shown in FIG. 10, the distal portion 3010 may be comprised of a first member 3110, a second member 3120, a third member 3130, a fourth member 3140, a fifth member 3150, and a sixth member 3160 that may be attached to each other by a conventional method such as, but not limited to, gluing, stapling, stitching, and/or riveting. As shown in FIG. 10, the first member 3110, the second member 3120, the third member 3130, the fourth member 3140, the fifth member 3150, and the sixth member 3160 may be arranged to form a cup like structure having hexagonal hole through which a portion of the weight 4000 may pass. Each of the first member 3110, the second member 3120, the third member 3130, the fourth member 3140, the fifth member 3150, and the sixth member 3160 forming the cup like structure may contact and support the weight 4000. In example embodiments, the hexagonal hole of the bag 3000 may be sized so that the weight 4000 cannot pass completely therethrough. For example, a cross distance CD of the opening may be, but is not limited to, about three inches. For example, the cross distance CD may be about two inches to about five inches.

Although example embodiments illustrate a bottom portion of the bag 3000 as being comprised of six members (3110, 3120, 3130, 3140, 3150, and 3160), example embodiments are not limited thereto as the bottom portion may include more or less than six members. For example, the bottom portion may resemble a cup like member comprised of only a single strap like material or a cup like member which is formed from a substantially rigid material such as a hard plastic or a flexible material such as rubber. Furthermore, example embodiments are not limited to a bag having a hexagonal hole since the hole may have another shape such as, but not limited to, a circular hole, a triangular hole, a square hole, a rectangular hole, or an octagonal hole.

In example embodiments, the bag 3000 may have a first plurality of looped members 3200. For example, as shown in FIGS. 7 and 9, the first plurality of looped members 3200 may be attached to the distal portion 3010 of the bag 3000 by a conventional method such as, but not limited to, stitching, stapling, gluing, and/or riveting. In example embodiments, the first plurality of looped members 3200 may include a first looped member 3210, a second looped member 3220, a third looped member 3230, a fourth looped member 3240, a fifth looped member 3250, and a sixth looped member 3260. Although example embodiments illustrate the first plurality of looped members 3200 as being comprised of six looped members, example embodiments are not limited thereto as there may be more or less than six looped members in the first plurality of looped members 3200. In example embodiments, some of all of the members of the first plurality of looped members 3200 may be made of a relatively stiff material for example, nylon, Kevlar, or a polyester. For example, some or all of the pieces may resemble the type of material found in a seat belt of a car.

In example embodiments, the bag 3000 may further have a second plurality of looped members 3300. For example, as shown in FIGS. 7 and 9, the second plurality of looped members 3300 may form a proximal portion 3020 of the bag 3000. In example embodiments, the second plurality of looped members 3300 may include a first looped member 3310 and a second looped member 3320. Although example embodiments illustrate the second plurality of looped members 3300 as being comprised of two looped members, example embodiments are not limited thereto as there may be more or less than two looped members in the second plurality of looped members 3300. In example embodiments, some of all of the members of the second plurality of looped members 3300 may be made of a relatively stiff material for example, nylon, Kevlar, or a polyester. For example, some or all of the pieces may resemble the type of material found in a seat belt of a car. Example embodiments, however, are not limited thereto as the second plurality of looped member may be comprised of two metal rings in place of the first looped member 3310 and the second looped member 3320.

Though not shown in FIGS. 7-10, a material may be placed between the weight 4000 and the opening at the distal end of the bag 3000. Thus, the hole formed at the distal end of the bad 3000 may be covered by the material. The material, for example, may be a thin fabric or a thin rubber or rubberlike material.

In example embodiments, the first looped member 3310 may loop through the loops of the first looped member 3210, the second looped member 3220, and the third looped member 3230. Similarly, the second looped member 3320 may loop through the loops of the fourth looped member 3240, the fifth looped member 3250, and the sixth looped member 3260. In example embodiments, the weight 4000 may be inserted into the bag 3000 by pulling the first loop 3310 and the second loop 3320 apart from one another. The bag 3000 may be closed by bringing together the first and second loop 3310 and 3320 together. As shown in at least FIG. 9, the second interfacing member of the connector 2000 may be used to secure the bag 3000 to the connector 2000. For example, in example embodiments, after the weight 4000 is inserted into the bag, the second plurality of loops may be inserted into an open area of the second interfacing member the connector and the securing member 240 may be inserted into the first and second loops 3310 and 3320 to secure the bag 3000 to the connector 2000.

Figure 11:
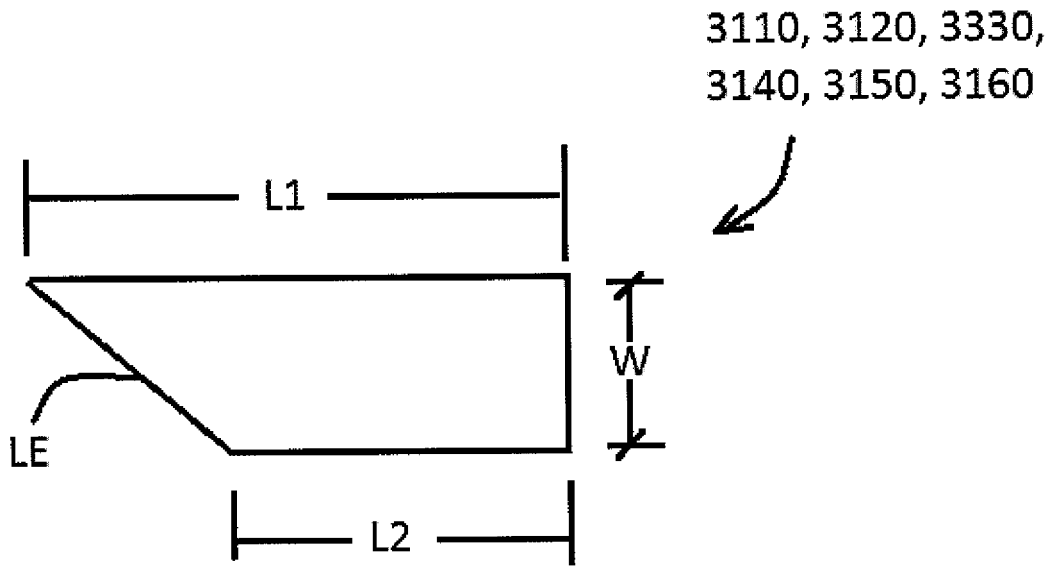
FIG. 11 is a view of a member making up a bottom portion of the bag in accordance with example embodiments.

As shown in FIGS. 7-15, the bag 3000 may resemble a web with several pieces connected together. For example, in example embodiments, each of the members 3110, 3120, 3130, 3140, 3150, and 3160 forming the bottom bag portion of the bag 3000 may be formed from a fabric having a trapezoidal shape as shown in FIG. 11. For example, each of the members 3110, 3120, 3130, 3140, 3150, and 3160 may be constructed from a fabric resembling the type found in conventional seatbelts. In example embodiments, each of the members 3110, 3120, 3130, 3140, 3150, and 3160 may have a thickness of about one sixteenth of an inch, a width W of about one and three quarters of an inch, a first length L1 of about five inches and a second length L2 of about three and one half inches. Example embodiments, however, are not limited by the instant dimensions since such dimensions are given for the purpose of illustration only. Thus, each of the members 3110, 3120, 3130, 3140, 3150, and 3160 may have a thickness of greater than or less than one sixteenth of an inch, a width W of greater than or less than one and three quarters of an inch, a first length L1 of greater than or less than about five inches and a second length L2 greater than or less than about three and one half inches.

Figure 12:
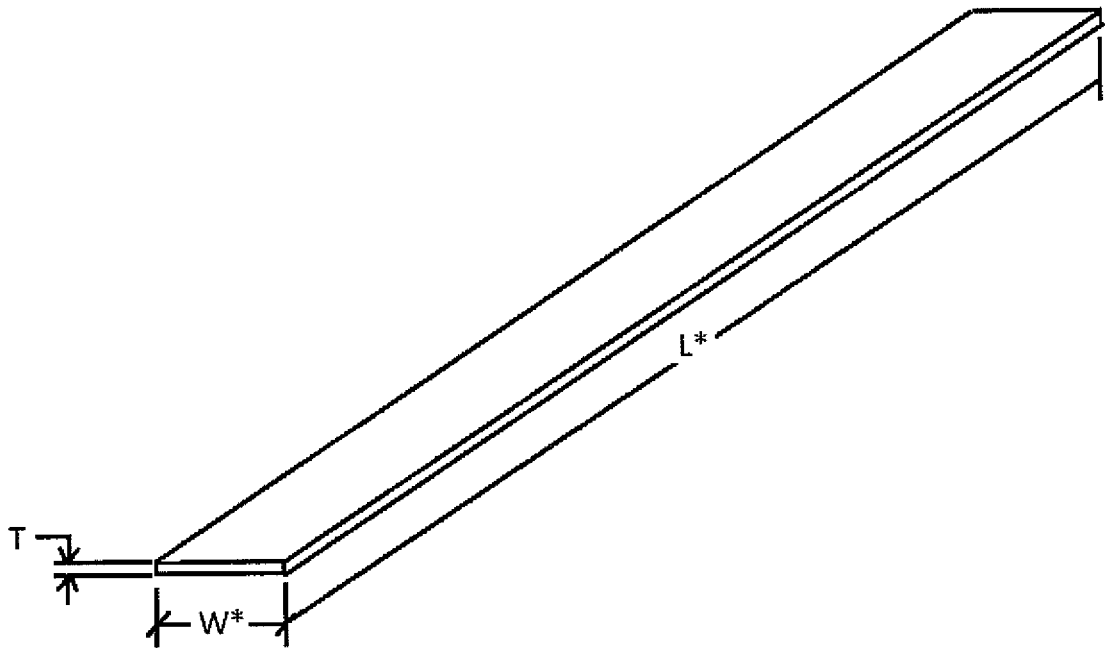
FIG. 12 is a view of a material usable for forming a looped member in accordance with example embodiments.

In example embodiments, each of the first plurality of looped members 3200 may be constructed from a fabric that resembles a seat belt. For example, as shown in FIG. 12, the first plurality of looped members 3200 may be made from a rectangular fabric having a thickness T of about one sixteenth of an inch, a length L* of about fourteen inches, and width W* of about three quarters of an inch. Example embodiments, however, are not limited by the instant dimensions since such dimensions are given for the purpose of illustration only. Thus, each of the looped members 3210, 3220, 3230, 3240, 3250, and 3260 may have a thickness T of greater than or less than one sixteenth of an inch, a width W* of greater than or less than one and three quarters of an inch, and a length L* of greater than or less than about fourteen inches.

The bag 3000 may be formed by attaching each of the members 3110, 3120, 3130, 3140, 3150, 3160 and the looped member 3210, 3220, 3230, 3240, 3250, and 3260 to one another via a conventional means such as, but not limited to, gluing, stitching, stapling, and riveting. Below illustrates an example method which may be used to form the bag 3000 in accordance with example embodiments. The method is for the purpose of illustration only and is not intended to limit example embodiments as one skilled in the art would understand the bag 3000 may be made in many different ways.

Figure 13:
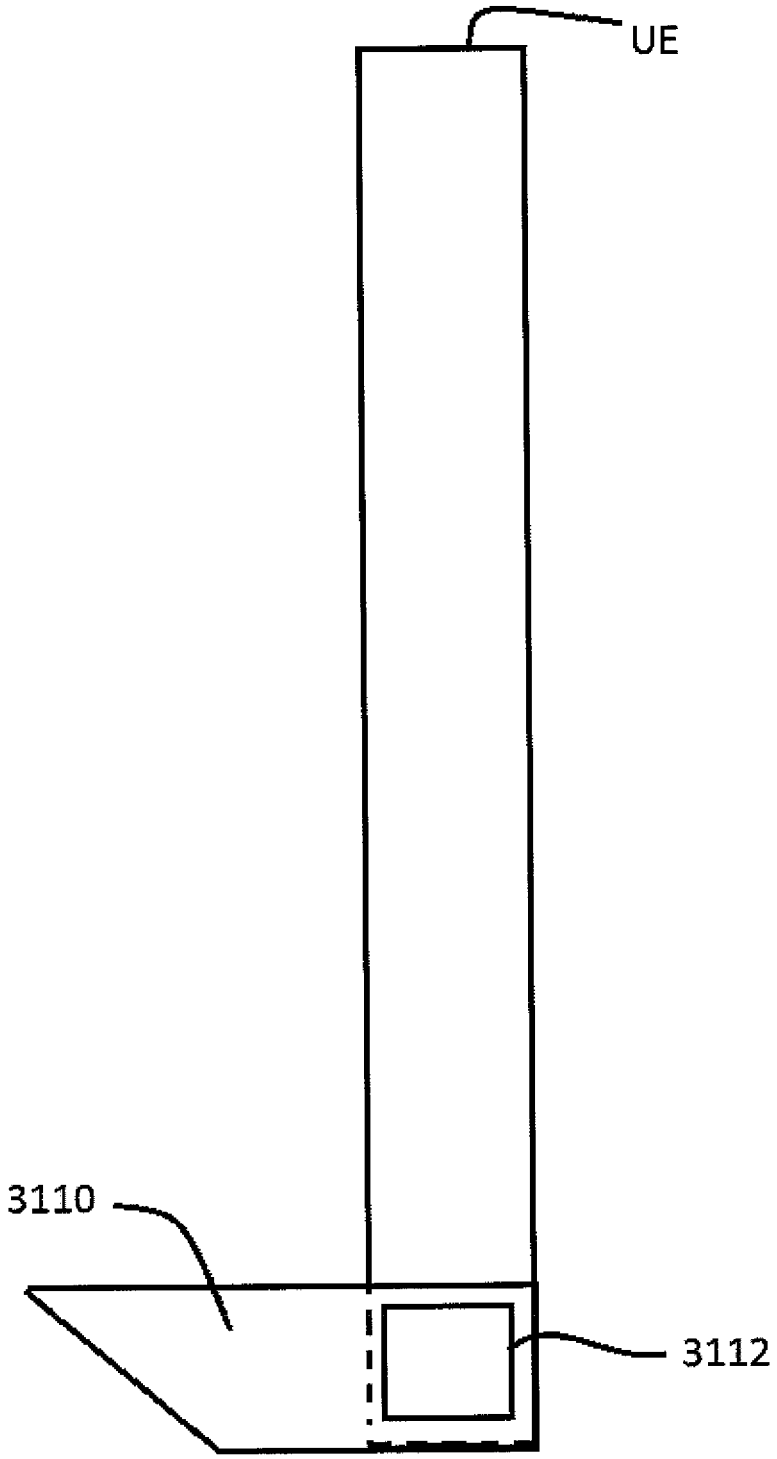
FIG. 13 is a view of the material connected to the member in accordance with example embodiments.
Figure 14A:
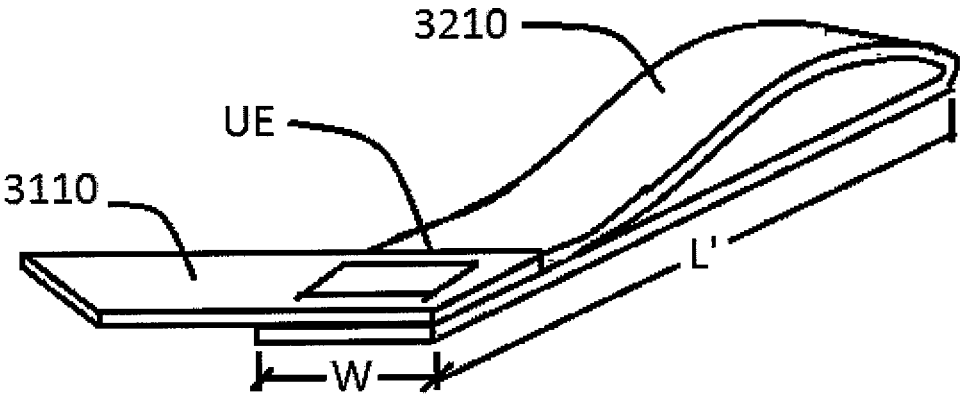
FIGS. 14A and 14B illustrate an example of the material being folded to form a looped member in accordance with example embodiments.
Figure 14B:
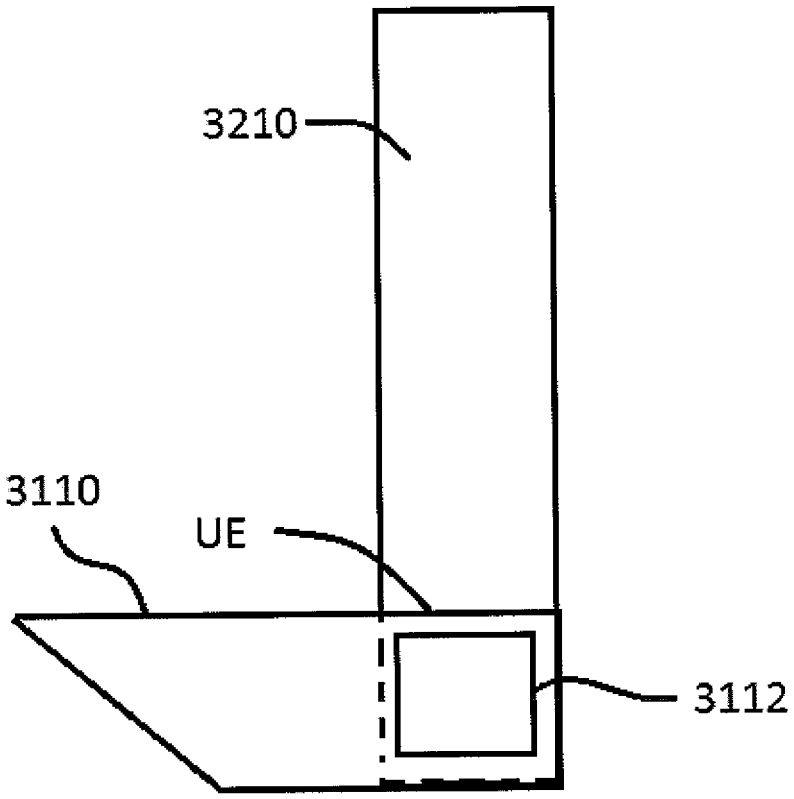

Referring to FIG. 13, a rectangular member, similar or identical to the one illustrated in FIG. 12, may have a first corner aligned with a second corner of the first member 3110 as shown in FIG. 14, so that a portion of the rectangular member overlaps a portion of the first member 3110. In example embodiments, the rectangular member may be attached to the first member 3110 by a conventional means such as gluing, stitching, or riveting. In example embodiments, a stitching pattern 3112 is illustrated in FIG. 13 to illustrate the first member 3110 being stitched to the rectangular member. In example embodiments, each of the second member 3120, the third member 3130, the fourth member 3140, the fifth member 3150, and the sixth member 3160 may be attached to a rectangular member in a similar fashion.

Figure 15A:
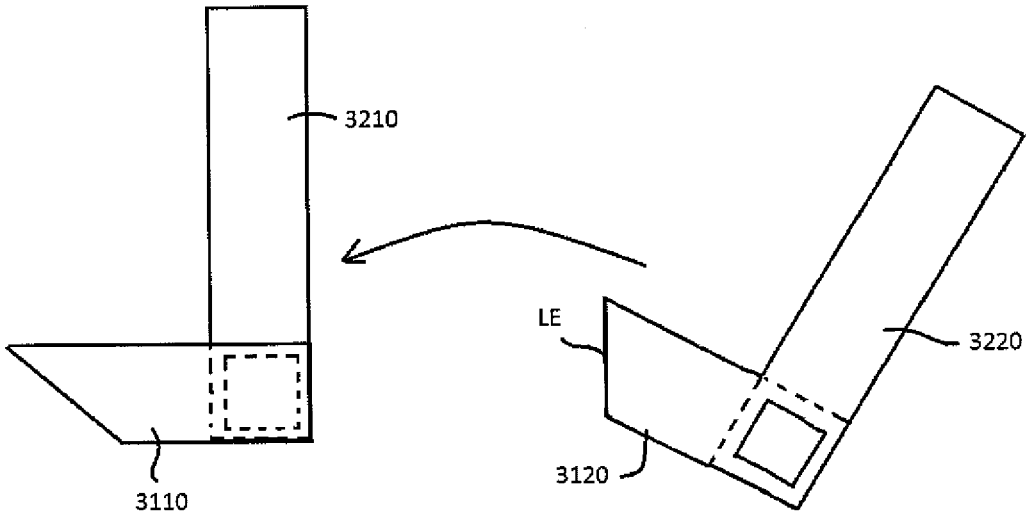
FIGS. 15A and 15B illustrate operations that form a bottom of the bag in accordance with example embodiments.
Figure 15B:
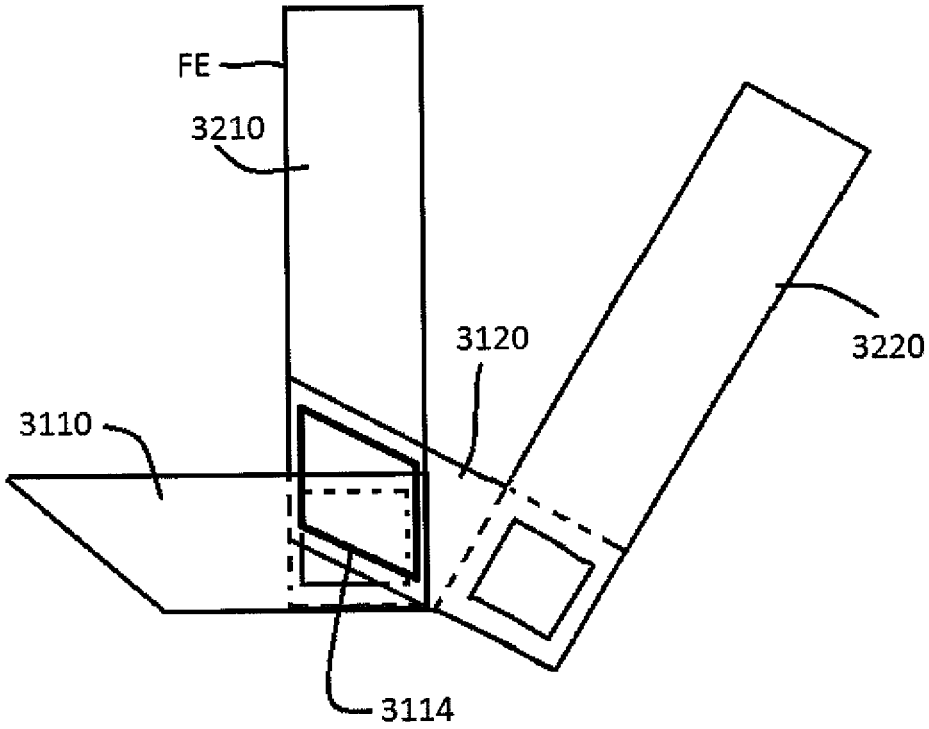
Figure 16:
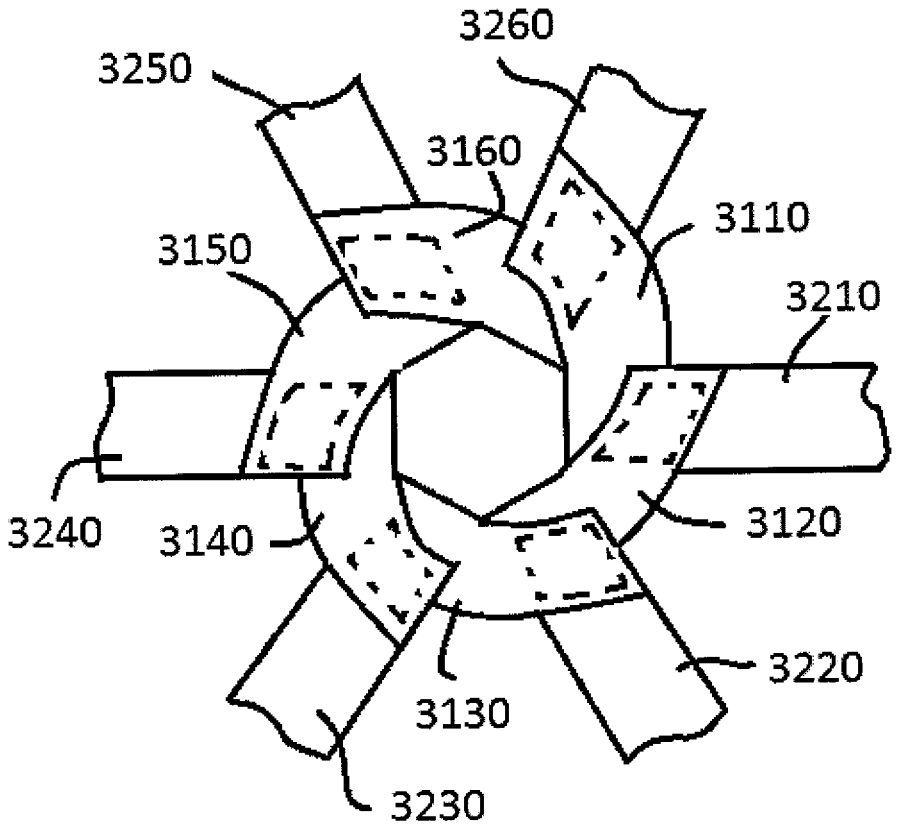
FIG. 16 is another view of the bottom of the bag in accordance with example embodiments.

In example embodiments, a portion of the rectangular member may be folded backwards so that an upper edge UE of the rectangular member is arranged adjacent an edge of the first member 3110 as shown in FIG. 14A thus forming the first looped member 3210. After the first looped member 3210 is formed, the second member 3120 with its rectangular member attached thereto may be arranged such that its leading edge LE is substantially aligned with an edge of the first loop 3210 as shown in FIG. 15B. In example embodiments, a middle portion of the leading edge LE of the second member 3120 may be arranged near the top edge of the first member 3110 and the forward edge FE of the first looped member 3210. A fastening structure, for example, a stitch, a rivet, or glue may be used connect the second member 3120 to the first member 3110 and the first looped member 3210. For example, as shown in FIG. 15B, a trapezoidal shaped stitching pattern 3114 connecting the second member 3120 to the first member 3110 and to the first looped member 3210 is shown. This process may be repeated until a bottom portion of the bag 300 is formed as shown in FIG. 16. In example embodiments, the trapezoidal shaped stitching pattern 3114 may serve more than one purpose. For example, in example embodiments, the trapezoidal stitching pattern 3114 may attach one a member of the lower portion 3100 to another member of the lower portion 3100, reinforce a connection between a member of the lower portion 3100 and its associated looped member, and secure the looping portion of the looped members of the first plurality of looped members 3200.

Although FIG. 16 shows the bottom of the bag 3000 formed by the above method as flat, it is understood that the bag 3000 may be formed so as to create a cupped shape having a hexagonal hole rather than forming a flat shaped structure.

While example embodiments have been particularly shown and described with reference to example embodiments thereof, it will be understood by those of ordinary skill in the art that various changes in form and details may be made therein without departing from the spirit and scope of the invention.

What I claim is:

1. A device for an athletic competition comprising:

a handle;

a single connector;

said single connector rotatably connecting a bag to the handle, wherein the bag may rotate, said bag constructed to provide a generally cup shaped structure and includes a hole at an end of the bag opposite the handle, the single connector includes a first interfacing member and a second interfacing member, each said interfacing member comprising a first extension member, a second extension member, and a base member connecting the first and second extension members, said first interfacing member connected to the handle and said second interfacing member connected to the bag, said first interfacing member and the second interfacing member configured to rotate about a common axis;

a spherical weight within the generally cup shaped structure, said weight comprising a diameter of between about 4 inches to about 9 inches and having a surface positioned in the bag with a portion of said surface extending through said hole at least coextensively with said hole to provide additional distance between the handle and said portion of the surface, said hole comprising a area between 3 square inches and 30 square inches and sized relative to the weight to prevent the weight from passing completely therethrough.

2. The device according to claim 1, wherein the hole has an area of about 5 to about 13 square inches.

3. The device according to claim 1, wherein the hole is hexagonal shaped.

4. The device according to claim 1, wherein the bag is comprised of a plurality of trapezoid shaped members forming the generally cup shaped structure, a first plurality of looped members, and a second plurality of looped members wherein each of said first plurality of looped members intersects with one of said second plurality of looped members.

5. The device according to claim 4, wherein one of the members of the first plurality of looped members is connected to another member of the first plurality of looped members and one of said plurality of trapezoid shaped members by a stitching.

6. A device comprising:

a handle;

a connector connected to the handle; and a bag, wherein the bag is comprised of a plurality of trapezoidal shaped members wherein each of said plurality of trapezoidal shaped members is associated with at least one of a first plurality of looped members by at least one of stitching, gluing, stapling, and riveting and each of the first plurality of looped members are attached to the connector by one of a second plurality of looped members.

7. The device according to claim 6, wherein the bag includes a hexagonal hole having a maximum diameter of about 2.5 to about 5 inches, said hole in the bag positioned opposite the connector and handle.

* * * * *